US009550156B2

(12) United States Patent
Chien

(10) Patent No.: US 9,550,156 B2
(45) Date of Patent: Jan. 24, 2017

(54) GENERATION APPARATUS FOR DISSOLVING GAS IN LIQUID AND FLUID NOZZLE

(71) Applicant: TRUSVAL TECHNOLOGY CO., LTD., Miao-Li Hsien (TW)

(72) Inventor: Shih-Pao Chien, Miao-Li Hsien (TW)

(73) Assignee: TRUSVAL TECHNOLOGY CO., LTD., Miao-Li Hsien (TW)

( * ) Notice: Subject to any disclaimer, the term of this patent is extended or adjusted under 35 U.S.C. 154(b) by 66 days.

(21) Appl. No.: 14/607,103

(22) Filed: Jan. 28, 2015

(65) Prior Publication Data

US 2015/0258491 A1 Sep. 17, 2015

(30) Foreign Application Priority Data

Mar. 11, 2014 (TW) ..... 103204109 U

(51) Int. Cl.

| | |
|---|---|
| ***B01F 5/10*** | (2006.01) |
| ***B01F 5/02*** | (2006.01) |
| ***B01F 5/04*** | (2006.01) |
| ***B01F 3/04*** | (2006.01) |

(52) U.S. Cl.

CPC ..... *B01F 5/106* (2013.01); *B01F 3/0451* (2013.01); *B01F 5/0212* (2013.01); *B01F 5/0428* (2013.01)

(58) Field of Classification Search

CPC .... B01D 1/0054; B01D 1/0071; B01F 5/0212; B01F 5/106; B01F 3/0451; B01F 5/0428

See application file for complete search history.

(56) References Cited

U.S. PATENT DOCUMENTS 1,457,536 A * 6/1923 MacLean ..... F04D 17/18 417/67
1,808,956 A * 6/1931 Ketterer ..... B01F 3/04106 261/36.1
2,057,100 A * 10/1936 Jespersen ..... C11C 3/123 261/29

(Continued)

FOREIGN PATENT DOCUMENTS

DE 1667042 A1 * 6/1971 ..... B01F 3/04539
JP WO 2013157202 A1 * 10/2013 ..... C02F 1/78

OTHER PUBLICATIONS

AZ Mixing Eductors published Oct. 4, 2010 view at <https://web.archive.org/web/20101004143022/http://www.cccmix.com/mixing-eductors/>.*

*Primary Examiner* — Amber R Orlando
*Assistant Examiner* — Stephen Hobson
(74) *Attorney, Agent, or Firm* — Rabin & Berdo, P.C.

(57) ABSTRACT

A generation apparatus for dissolving gas in liquid includes a sealed dissolving tank, a gas supply tube, a liquid supply set, and a fluid nozzle, wherein the sealed dissolving tank having a liquid inlet tube and a liquid outlet tube; a gas chamber formed inside the tank above liquid level; the gas supply tube supplying gas into gas chamber; the fluid nozzle disposed inside the tank; the liquid supply set supplying liquid to the fluid nozzle; the fluid nozzle disposed with at least a gas inlet and at least a liquid bubble inlet at different locations on shell wall; the gas inlet connected to a gas tube to the gas chamber, and the liquid bubble inlet located below the liquid level inside the tank. As such, the fluid nozzle performs at least two dissolving operations to miniaturize the bubbles to increase contact surface and improve dissolving efficiency.

8 Claims, 6 Drawing Sheets

(56) References Cited

U.S. PATENT DOCUMENTS 2,543,923 A * 3/1951 Mixsell ..... F04D 17/122 415/199.3
3,782,701 A * 1/1974 Hunt ..... B01F 3/0412 210/220
3,788,616 A * 1/1974 Clough, Jr. ..... B01F 3/04531 261/64.1
3,891,729 A * 6/1975 Ebner ..... B01F 3/04 261/87
3,911,064 A * 10/1975 McWhirter ..... B01F 3/04539 210/220
4,211,733 A * 7/1980 Chang ..... B01F 3/0876 210/220
4,469,596 A * 9/1984 Kantor ..... C02F 1/72 137/236.1
4,975,197 A * 12/1990 Wittmann ..... C02F 3/1257 210/626
5,045,202 A * 9/1991 Stearns ..... B01F 3/0446 210/628
5,057,284 A * 10/1991 Emmett, Jr. ..... B01F 3/04269 266/168
5,451,348 A * 9/1995 Kingsley ..... B01F 3/04609 261/36.1
5,762,833 A * 6/1998 Gross ..... B01F 7/1635 261/93
5,795,138 A * 8/1998 Gozdawa ..... F04D 17/12 417/243
6,808,165 B1 * 10/2004 Sperber, Jr. ..... B01F 3/04539 261/120
7,063,519 B2 * 6/2006 Agrawal ..... F04D 25/06 417/365
8,668,187 B2 * 3/2014 Al-Anzi ..... C02F 1/74 261/116
9,486,753 B1 * 11/2016 Vlasak ..... B01F 3/04503
2003/0175128 A1 * 9/2003 Fabry ..... F04D 27/02 417/243
2005/0098497 A1 * 5/2005 Khudenko ..... B01D 19/0031 210/620
2005/0210875 A1 * 9/2005 Larue ..... F16C 17/024 60/602
2008/0143000 A1 * 6/2008 Sun ..... B01F 3/04539 261/30
2009/0256269 A1 * 10/2009 Sun ..... B01F 3/04539 261/93
2009/0290993 A1 * 11/2009 Assaf ..... F01C 17/02 417/68
2010/0111725 A1 * 5/2010 Knoop ..... F04D 29/0513 417/372
2011/0229313 A1 * 9/2011 Beers ..... B64D 13/06 415/180
2011/0243762 A1 * 10/2011 Daikoku ..... F04D 25/0606 417/321
2013/0280042 A1 * 10/2013 Beers ..... B64D 13/06 415/116
2015/0266759 A1 * 9/2015 Morgan ..... C02F 3/006 210/614

* cited by examiner

GENERATION APPARATUS FOR DISSOLVING GAS IN LIQUID AND FLUID NOZZLE

CROSS-REFERENCE TO RELATED APPLICATION

The present application is based on, and claims priority form, Taiwan Patent Application No. 103204109, filed Mar. 11, 2014, the disclosure of which is hereby incorporated by reference herein in its entirety.

TECHNICAL FIELD

The technical field generally relates to an apparatus for dissolving gas in liquid, and in particular, to a technique utilizing jet agitation to miniaturize bubbles to increase contact area between gas and liquid so as to increase dissolving efficiency and reduce dissolving time.

BACKGROUND

The known generation apparatus for dissolving gas in liquid often uses diffuser or Venturi tube for assisting the process. FIG. 1 shows a schematic view of the structure of a known apparatus using diffuser. As shown in FIG. 1, the apparatus includes a high-pressure gas tank 11, a dissolving tank 12 and a diffuser 13 disposed in the tank 12. The dissolving tank 12 further includes a liquid inlet tub 121, a fluid outlet tube 122 and a gas venting tube 123 for allowing the liquid to enter the dissolving tank and outputting a high density gas-liquid solution. The high-pressure gas tank 11 is connected to the diffuser 13 through a gas tube 14. The diffuser 13 allows the entering gas to generate a large amount of tiny bubbles. By increasing the contact area between the tiny bubbles and the liquid, the dissolving efficiency is increased during the bubble surfacing time to obtain a high density gas-liquid solution. When the gas inside the dissolving tank 12 to much or the pressure is too high, the un-dissolved gas can be vented out through the gas venting tube 123. However, known disadvantages of the above apparatus include the following:

1. The bubbles, after surfacing above the liquid level, cannot be recycled and reused.

2. To keep the bubbles remain in the liquid long enough for improving the dissolving efficiency, the dissolving tank must be sufficiently deep, which would take up much space.

FIG. 2 shows a schematic view of the structure of a known apparatus using Venturi tube. As shown in FIG. 2, the Venturi tube 21 includes a liquid inlet tube 211, a liquid outlet tube 212 and a gas inlet tube 213. The liquid inlet tube 212 is connected to a liquid transmission tube 22 and a pump 23 so that the liquid can be transmitted into the Venturi tube 21. The gas to be dissolved in the liquid enters through the gas inlet tube 213 to be mixed with the liquid. The theory behind the above apparatus is: using the high speed jet current generated by the high-pressure liquid entering the throat of the tube with a smaller diameter to cause negative pressure to suck the gas into the tube throat for mixing with the high-speed jet current and flowing out a solution with dissolved gas. The known disadvantage is the above apparatus is that the amount of gas is restricted by the liquid flowing speed. As such, the range for adjustment is limited, the generated bubbles are often bigger and the contact area is smaller, leading to less efficiency.

SUMMARY

The primary object of the present disclosure is to provide a high efficiency generation apparatus for dissolving gas in liquid, through multi-iteration bubble miniaturization to increase total surface area of the gas and through prolonging the duration of the bubble remaining inside the dissolving tank. With increased contact surface and prolonged time in liquid, the dissolving efficiency is improved so as to obtain more high density gas-liquid solution in a unit time.

Another object of the present disclosure is to provide a generation apparatus for dissolving gas in liquid with less gas waste. The apparatus is able to dissolve the gas more effectively and the un-dissolved gas is recycled inside the tank to reduce the waste of gas. The bubbles surfacing to the liquid level is sucked into the liquid to become tiny bubble for dissolving to further reduce the waste of gas.

To achieve the aforementioned objects, the present disclosure provides a generation apparatus for dissolving gas in liquid, including a sealed dissolving tank, a gas supply tube, a liquid supply set, and a fluid nozzle, wherein the sealed dissolving tank having a liquid inlet tube and a liquid outlet tube; a gas chamber being formed inside the sealed dissolving tank above the liquid level; the gas supply tube being linked to the sealed dissolving tank and connected to the gas chamber for supplying gas into the gas chamber; the liquid supply set including a liquid transport tube, a pump and a liquid supply tube; the liquid transport tube supplying the liquid to the pump, the pump pressurizing the liquid for outputting by the liquid supply tube; the liquid supply tube extending into the seal dissolving tank; the fluid nozzle being disposed inside the sealed dissolving tank, the fluid nozzle having a solution channel and being disposed with at least a gas inlet and at least a liquid bubble inlet at different locations on shell wall of fluid nozzle; both the gas inlet and the liquid bubble inlet being connected to the solution channel; the solution channel having an entrance connected to the liquid supply tube, and an exit located below the liquid level inside the tank; the gas inlet further connected to a gas tube to the gas chamber, and the liquid bubble inlet located below the liquid level inside the tank.

The fluid nozzle of the present disclosure uses a structure of Venturi tube for gas and liquid phases. When used, the fluid nozzle can suck in gas and a liquid bubble of mixed gas and liquid in turns. The gas inlet is closer to the entrance to the solution channel than the liquid bubble inlet. When the solution is transported into the fluid nozzle, the velocity increased and the large amount of gas is sucked into the gas inlet for mixing with the high speed liquid, and flows out from the solution channel. The un-dissolved gas surfaces and passes the liquid bubble inlet. Because of the negative pressure caused by fast flow speed inside the solution channel the nearby liquid and bubble are sucked in by the liquid bubble inlet. The act of liquid sucking generates a shear force, which breaks down the bubble into smaller bubbles for dissolving easily. This double cyclic operation increases the contact surface between the gas and the liquid to improve dissolving efficiency. Also, the vertical cyclic operation inside the tank prolongs the duration the bubble remaining in the liquid. As such, with increased contact surface and prolonged contact time, the dissolving efficiency of the present disclosure is improved.

In addition, the liquid supply set further includes a gas sucking tube, with one end connected to the liquid transport tube and the other connected to the gas chamber. As such, when the liquid transport tube transports liquid, the gas is also sucked in through the gas sucking tube so that a large amount of bubbles is inside the liquid. Because the pump operates by vane centrifugal pressurization, the vane can further break down the bubble into smaller bubbles during the centrifugal pressurization, and transports the smaller bubbles through the liquid supply tube to the fluid nozzle. This process also increases the surface area of the bubble to improve gas dissolving.

The present disclosure is applicable to any operation of dissolving gas in liquid, such as, carbon dioxide in de-ionized water, ozone in de-ionized water, ammonia in de-ionized water, and so on.

The foregoing will become better understood from a careful reading of a detailed description provided herein below with appropriate reference to the accompanying drawings.

BRIEF DESCRIPTION OF THE DRAWINGS

The embodiments can be understood in more detail by reading the subsequent detailed description in conjunction with the examples and references made to the accompanying drawings, wherein.

DETAILED DESCRIPTION OF THE DISCLOSED EMBODIMENTS

Figure 1:
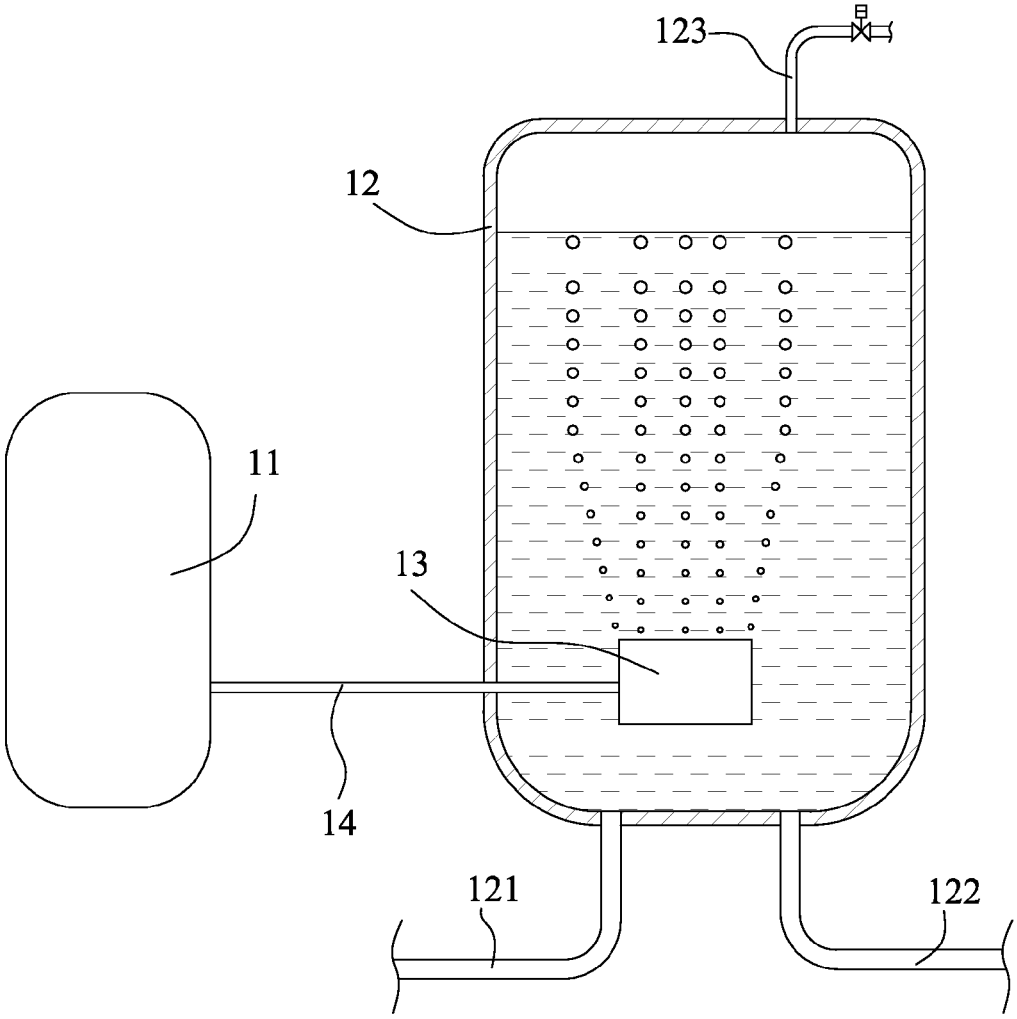
FIG. 1(Prior Art)
FIG. 1 shows a schematic view of the structure of a known apparatus using diffuser.
Figure 2:
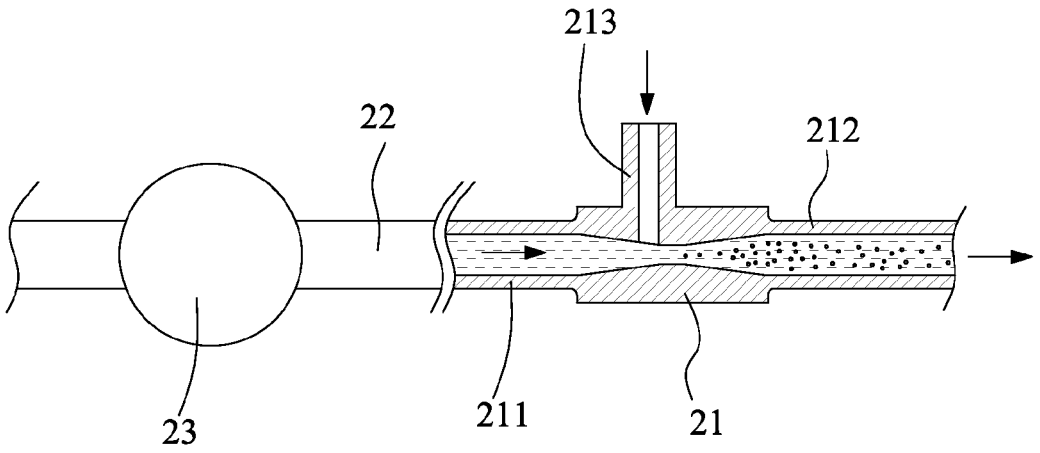
FIG. 2(Prior Art)
FIG. 2 shows a schematic view of the structure of a known apparatus using Venturi tube.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 3:
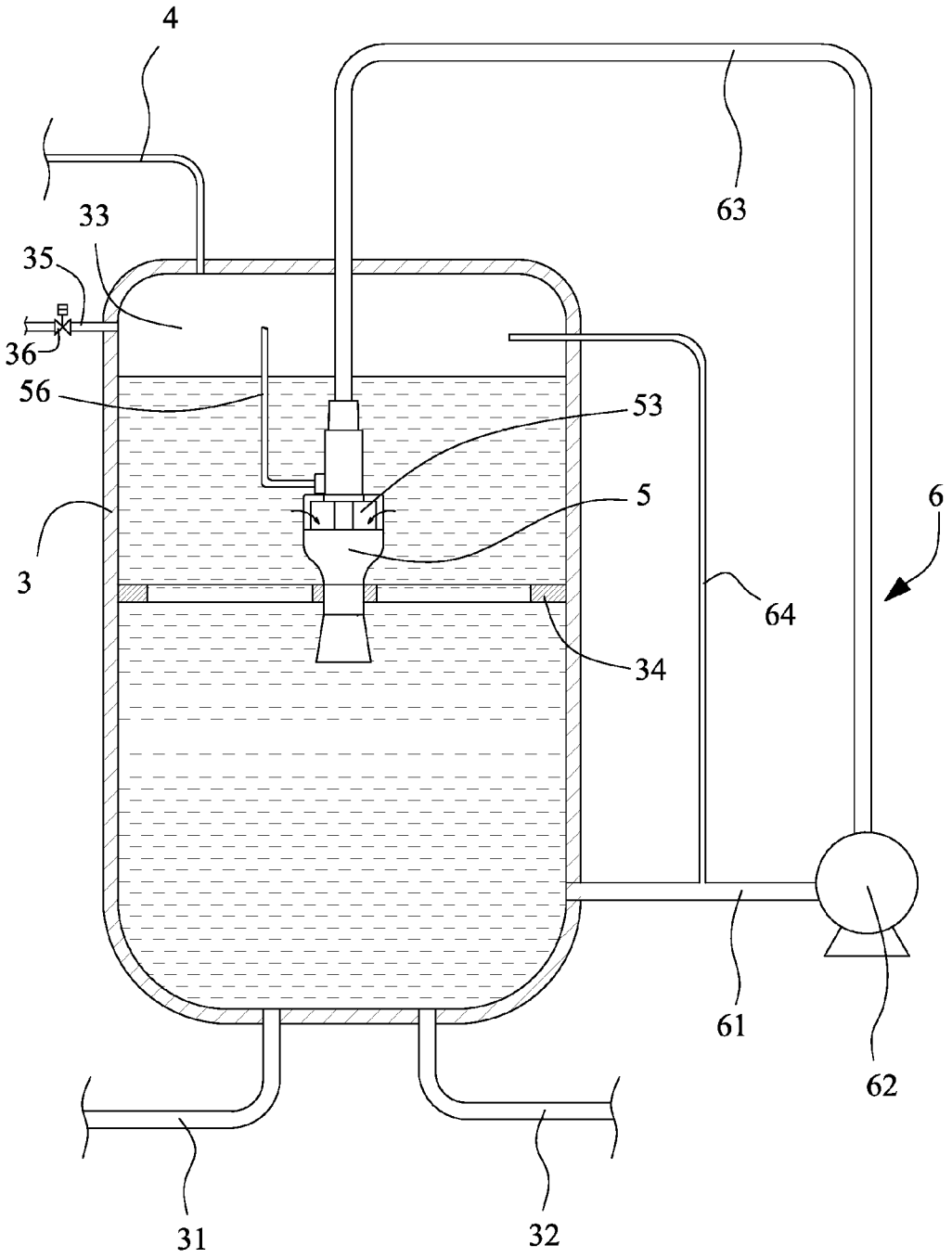
FIG. 3 shows a schematic view of an embodiment of the present disclosure.

FIG. 3 shows a schematic view of an embodiment of the present disclosure. The generation apparatus for dissolving gas in liquid of the present disclosure includes: a sealed dissolving tank 3, a gas supply tube 4, a fluid nozzle 5, and a liquid supply set 6.

The sealed dissolving tank 3 is a sealed container with a liquid inlet tube 31 and a liquid outlet tube 32. The liquid enters the tank through the liquid inlet tube 31, after internal operation, and a high density gas solution flows out from the liquid outlet tube 32. A gas chamber 33 is formed inside the sealed dissolving tank 3 above the liquid level. The gas chamber 33 is for housing the gas to be dissolved. The gas supply tube 4 is linked to the sealed dissolving tank 3 and is connected to the gas chamber 33 for supplying gas into the gas chamber 33. The gas is to be dissolved in the liquid. The sealed dissolving tank further includes a gas vent tube 35 connected to the gas chamber 33. The gas vent tube 35 is disposed with a automatic valve 36, which will be automatically opened to vent out a part of gas to maintain normal operation when the pressure inside the sealed dissolving tank 3 reaching a default threshold.

Figure 4:
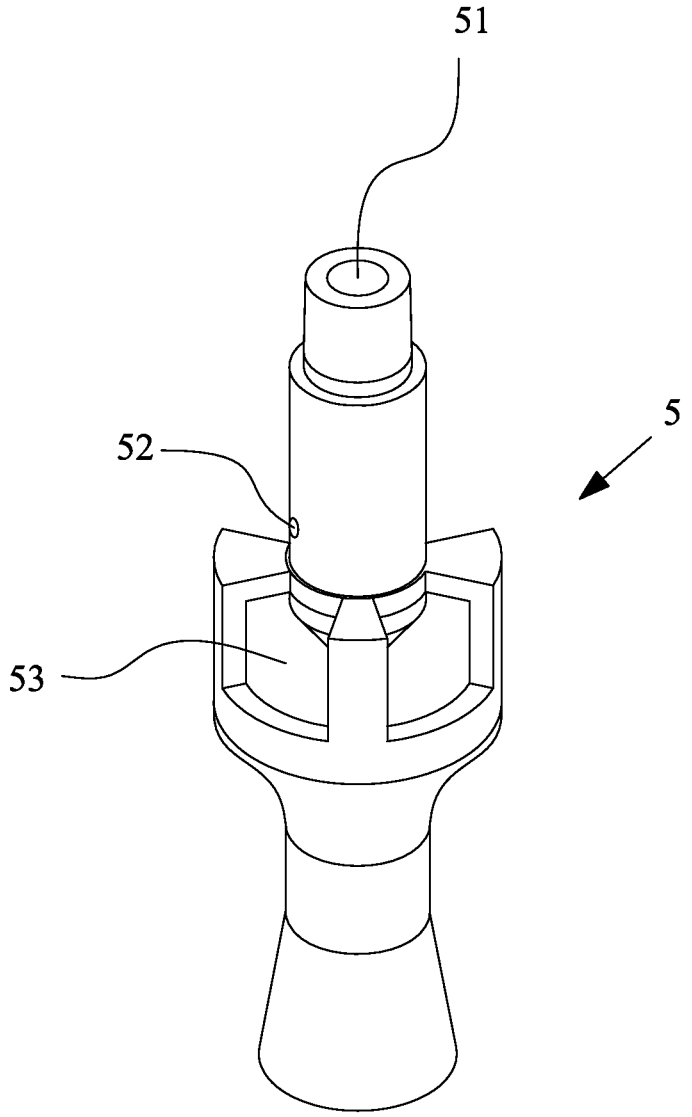
FIG. 4 shows a schematic view of an embodiment of the fluid nozzle of the present disclosure.
Figure 5:
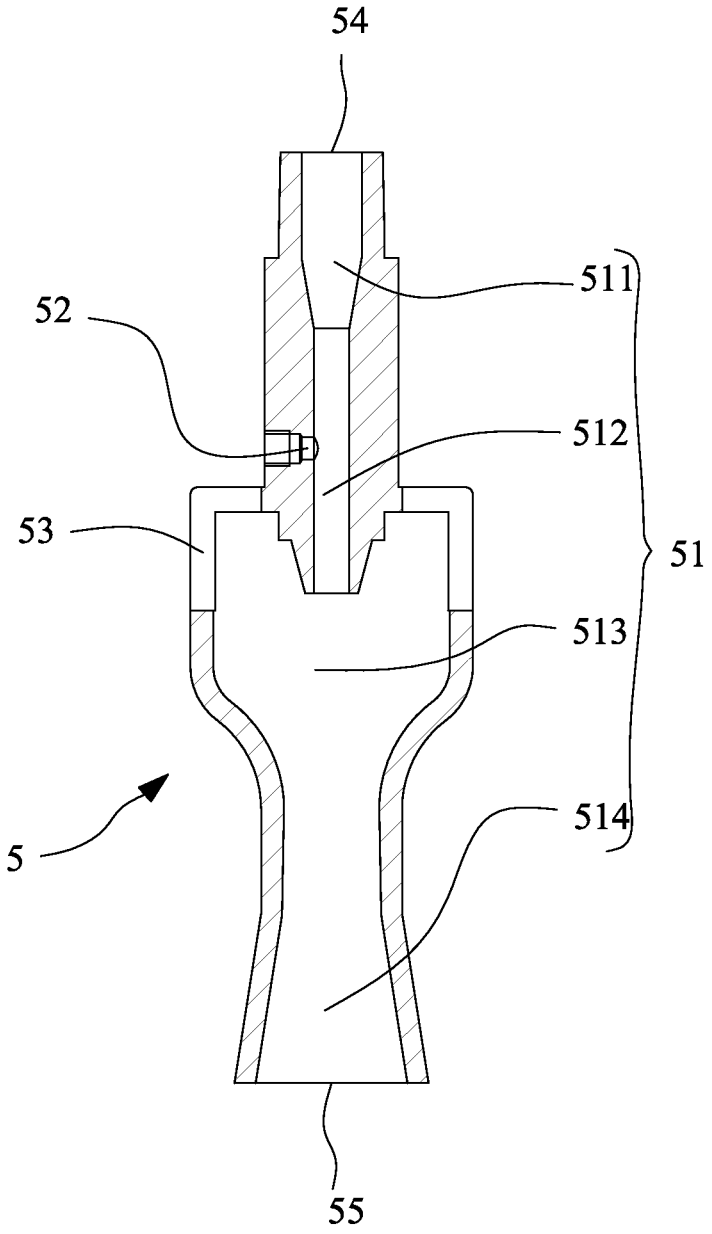
FIG. 5 shows a cross-sectional view of an embodiment of the fluid nozzle of the present disclosure.

The fluid nozzle 5 is disposed inside the sealed dissolving tank 3. A support frame 34 is disposed inside the tank to fix the position of the fluid nozzle 5. The fluid nozzle 5 can suck in gas and the liquid bubble of mixed gas and liquid. After twice stirring, the bubbles are miniaturized to increase contact surface between the gas and the liquid to accelerate dissolving. As shown in FIG. 4 and FIG. 5, the fluid nozzle 5 includes a solution channel 51, and also includes at least a gas inlet 52 and at least a liquid bubble inlet 53 at different locations on the shell wall. Both the gas inlet 52 and the liquid bubble inlet 53 are connected to the solution channel 51. The gas inlet 52 is also connected to a gas tube 56, leading to the gas chamber 33. The solution channel 51 passes through the fluid nozzle 5 and includes a plurality of channel segments of different diameters linked in series. As in the present embodiment, the solution channel 51 includes a first segment 511, a second segment 512, a third segment 513 and a fourth segment 514. The solution channel 51 has an entrance 54 located at the entrance of the first segment 511. The gas inlet 52 is linked to the second segment 512. The liquid bubble inlet 53 is linked to the third segment 513. The solution channel 51 has an exit 55 located at the exit of the fourth segment 514. The path of solution channel entrance 54 and the first segment 511 has a cross-section area larger than the cross-section area of the path of the second segment 512. Because the cross-section area shrinks, the fluid velocity increases. The negative pressure caused by the high speed jet current results in the sucking in of the gas through the gas inlet 52. Although the path cross-section of the third segment 513 is larger than the second segment 512, the velocity here is higher than the velocity at the outer wall of the fluid nozzle 5. With the high speed negative pressure and the abrupt enlarged part of the third segment 513, a swirl will be generated inside the third segment 513. The liquid bubble inlet 53 sucks in un-dissolved gas (bubble) and liquid. The swirl generates a shear force to further break down the bubbles into smaller bubbles to increase contact surface between the gas and the liquid and improve the dissolving efficiency. In addition, the diameter of the third segment 513 gradually shrinks along the flow direction, while the diameter of the fourth segment 514 gradually increases along the flow direction. The joint of the third segment 513 and the fourth segment 514 forms a tube throat with smaller diameter. As such, the velocity is accelerated and when the liquid flows out from the solution channel exit 55, a jet current is generated to further accelerate the stirring inside the tank to improve the dissolving.

The liquid supply set 6 is for supplying pressurized liquid to the fluid nozzle 5. The liquid supply set 6 includes a liquid transport tub 61*e*, a pump 62 and a liquid supply tube 63. The pump 62 is connected to the liquid transport tube 61 and the liquid supply tube 63. The liquid transport tube 61 supplies the liquid to the pump 62, and the pump 62 pressurizes the liquid for outputting by the liquid supply tube 63. In the present embodiment, the liquid transport tube 61 is connected to the seal dissolving tank 3 and located below the surface of the liquid to supply the liquid directly inside the tank. However, in other embodiments, the liquid can also be from external liquid supply device through the liquid transport tube 61 or connecting the liquid transport tube 61 to the liquid inlet tube 31 for supplying the liquid. The liquid supply tube 63 extends into the sealed dissolving tank 3, and is connected to the solution channel entrance 54 of the fluid nozzle 5. In the present embodiment, the support frame 34 for fluid nozzle 5 can also be omitted. Instead, a liquid supply tube 63 of sufficient diameter and strength can be directly connected to the fluid nozzle 5.

the fluid nozzle being disposed inside the sealed dissolving tank, the fluid nozzle having a solution channel and being disposed with at least a gas inlet and at least a liquid bubble inlet at different locations on shell wall of fluid nozzle; both the gas inlet and the liquid bubble inlet being connected to the solution channel; the solution channel having an entrance connected to the liquid supply tube, and an exit located below the liquid level inside the tank; the gas inlet further connected to a gas tube to the gas chamber, and the liquid bubble inlet located below the liquid level inside the tank.

The liquid supply set 6 of the present disclosure further includes a gas sucking tube 64, with one end connected to the liquid transport tube 61 and the other connected to the gas chamber 33 of the sealed dissolving tank 3. When the pump 62 operates and the liquid transport tube 61 transports liquid, the gas is also sucked in through the gas sucking tube 64 so that a large amount of bubbles is inside the liquid. Because the pump 62 operates by vane centrifugal pressurization, the vane can further break down the bubble into smaller bubbles during the centrifugal pressurization, and transports the smaller bubbles through the liquid supply tube 63 to the fluid nozzle 5. This process also increases the surface area of the bubble to improve gas dissolving.

Figure 6:
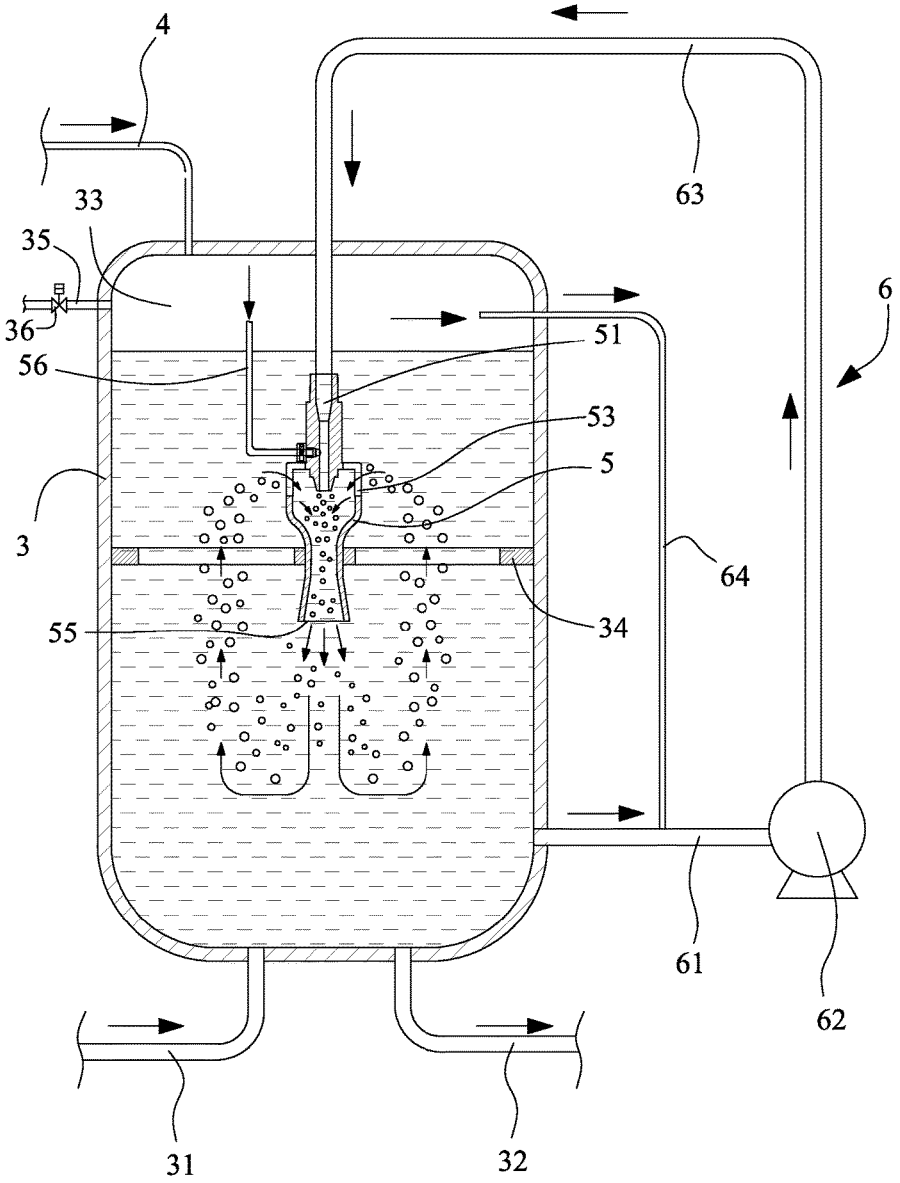
FIG. 6 shows a schematic view of the operation of the present disclosure.

The following describes the operation of the generation apparatus. FIG. 6 shows a schematic view of the operation of the present disclosure. As shown in FIG. 6, the liquid enters the sealed dissolving tank 3 through the liquid inlet tube 31 so that the liquid level maintains at a suitable level. The gas to be dissolved enters the gas chamber 33 through the gas supply tube 4. The liquid supply set 6 starts to operate to transport the liquid to the fluid nozzle 5. As described earlier, when the pump 62 operates, the gas is also sucked in during sucking in the liquid. During the pump 62 pressurization, the bubbles are broken down into smaller bubbles so that a part of gas is dissolved in the liquid. The un-dissolved smaller bubbles and the liquid are outputted to the solution channel 51 through the liquid supply tube 63.

When the liquid enters the solution channel 51 of the fluid nozzle, with the pressure difference caused by different diameters of different segments of the solution channel 51 and the resulted negative pressure, a large amount of gas is sucked through the gas tube 56 to the gas inlet 52. After gas-liquid dissolving, the solution is outputted through the solution channel exit 55. The un-dissolved gas surfaces and passes the liquid bubble inlet 53. Because the speed inside the solution channel 51 is higher than the speed outside, a negative pressure causes the nearby liquid and bubbles are sucked in through the liquid bubble inlet 53, which causes further swirl inside the solution channel 51. The shear force from the swirl breaks down the bubbles into smaller bubbles to further improve dissolving. The double cyclic operation increases the contact area between the gas and the liquid. The vertical cyclic operation inside the tank can prolong the time the bubbles remain in the liquid. With increased contact surface and prolonged contact time, the dissolving efficiency improves.

In summary, the present disclosure uses a set of fluid nozzle inside the sealed dissolving tank to perform the first dissolving operation, and then sucks in the un-dissolved gas and liquid again to break down the bubbles for efficient dissolving. In addition, the pump and the gas sucking tube of the liquid supply set perform another bubble miniaturization for efficient dissolving. As such, three times of dissolving operation, combined with the vertical cyclic operation inside the sealed dissolving tank to prolong contact time. Hence, the present disclosure can generate a large amount of high density gas solution and use gas efficiently in a unit time.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A generation apparatus for dissolving gas in liquid, comprising:

a sealed dissolving tank, having
- a liquid inlet tube and
- a liquid outlet tube,
- a gas chamber being formed inside the sealed dissolving tank above the liquid level;

a gas supply tube, linked to the sealed dissolving tank and connected to the gas chamber for supplying gas into the gas chamber;

a liquid supply set, further comprising
- a liquid transport tube,
- a pump,
- a gas sucking tube, and
- a liquid supply tube,
- the pump being connected to both the liquid transport tube and the liquid supply tube,
- the liquid transport tube being connected to the sealed dissolving tank and located below the liquid level,
- the gas sucking tube having one end connected to the liquid transport tube and the other end connected to the sealed dissolving tank for linking with the gas chamber,
- the liquid transport tube supplying the liquid to the pump,
- the pump pressurizing the liquid for outputting by the liquid supply tube;
- the liquid supply tube extending into the sealed dissolving tank; and a fluid nozzle, disposed inside the sealed dissolving tank, the fluid nozzle having a solution channel and being disposed with at least a gas inlet and at least a liquid bubble inlet at different locations on a shell wall of the fluid nozzle;

both the gas inlet and the liquid bubble inlet being connected to the solution channel;

the solution channel having an entrance connected to the liquid supply tube, and an exit located below the liquid level inside the sealed dissolving tank;

the gas inlet further connected to a gas tube to the gas chamber, and the liquid bubble inlet located below the liquid level inside the sealed dissolving tank, wherein the solution channel passing through the fluid nozzle and comprising a plurality of channel segments of different diameters linked in series, the plurality of channel segments comprising:
- a first segment,
- a second segment,
- a third segment, and
- a fourth segment;

the solution channel entrance located at an entrance of the first segment;

the gas inlet being linked to the second segment;

the liquid bubble inlet being linked to the third segment;

the solution channel having an exit located at the exit of the fourth segment;

a path of the solution channel entrance and the first segment having a cross-sectional area larger than a cross-sectional area of a path of the second segment;

a path of the third segment having a cross-sectional area larger than a cross-sectional area of the second segment;

a diameter of the third segment shrinking gradually along a flow direction;

a diameter of the fourth segment increasing gradually along the flow direction;

a joint of the third segment and the fourth segment forming a tube throat with a smaller diameter.

2. The generation apparatus for dissolving gas in liquid as claimed in claim 1, wherein the gas inlet is closer to the channel solution entrance than the liquid bubble inlet to the channel solution entrance.

3. The generation apparatus for dissolving gas in liquid as claimed in claim 1, wherein a joint between the gas inlet and the solution channel has a cross-section area smaller than the cross-section area of the solution channel entrance.

4. The generation apparatus for dissolving gas in liquid as claimed in claim 1, wherein a joint between the liquid bubble inlet and the solution channel has a cross-section area larger than the cross-section area of the solution channel entrance.

5. A fluid nozzle, applicable to a generation apparatus for dissolving gas in liquid, comprising a solution channel, the fluid nozzle being disposed with at least a gas inlet and at least a liquid bubble inlet at different locations on a shell wall of the fluid nozzle;

both the gas inlet and the liquid bubble inlet being connected to the solution channel;

the solution channel having an entrance connected to the liquid supply tube, and an exit located below the liquid level inside the sealed dissolving tank;

the gas inlet further connected to a gas tube to the gas chamber, and the liquid bubble inlet located below the liquid level inside the sealed dissolving tank, wherein the solution channel passing through the fluid nozzle and comprising a plurality of channel segments of different diameters linked in series, the plurality of channel segments comprising:

a first segment, a second segment, a third segment, and a fourth segment;

the solution channel entrance located at an entrance of the first segment;

the gas inlet being linked to the second segment;

the liquid bubble inlet being linked to the third segment;

the solution channel having an exit located at the exit of the fourth segment;

a path of the solution channel entrance and the first segment having a cross-sectional area larger than a cross-sectional area of a path of the second segment;

a path of the third segment having a cross-sectional area larger than a cross-sectional area of the second segment;

a diameter of the third segment shrinking gradually along a flow direction;

a diameter of the fourth segment increasing gradually along the flow direction;

a joint of the third segment and the fourth segment forming a tube throat with a smaller diameter.

6. The fluid nozzle as claimed in claim 5, wherein the gas inlet is closer to the channel solution entrance than the liquid bubble inlet to the channel solution entrance.

7. The fluid nozzle as claimed in claim 5, wherein a joint between the gas inlet and the solution channel has a cross-section area smaller than the cross-section area of the solution channel entrance.

8. The fluid nozzle as claimed in claim 5, wherein a joint between the liquid bubble inlet and the solution channel has a cross-section area larger than the cross-section area of the solution channel entrance.

* * * * *